US008316607B2

(12) United States Patent
Eisner et al.

(10) Patent No.: US 8,316,607 B2
(45) Date of Patent: Nov. 27, 2012

(54) METAL CEILING SYSTEM HAVING LOCKING PANELS WITHOUT VISIBLE ACCESS HOLES

(75) Inventors: Lester Eisner, Lakewood, CA (US); Tom Peterson, Ontario, CA (US); Albert Kiechle, Downey, CA (US); James Langan, Sequim, WA (US)

(73) Assignee: Ceilings Plus, Los Angeles, CA (US)

( * ) Notice: Subject to any disclaimer, the term of this patent is extended or adjusted under 35 U.S.C. 154(b) by 0 days.

(21) Appl. No.: 13/085,408

(22) Filed: Apr. 12, 2011

(65) Prior Publication Data

US 2011/0252735 A1 Oct. 20, 2011

Related U.S. Application Data

(60) Provisional application No. 61/325,159, filed on Apr. 16, 2010.

(51) Int. Cl.
*E04B 2/00* (2006.01)
*E04B 5/00* (2006.01)
*E04B 9/00* (2006.01)

(52) U.S. Cl. ..... 52/506.09; 52/506.01; 52/506.06; 52/506.07

(58) Field of Classification Search ..... 52/506.06, 52/506.07, 506.08, 506.09, 127.8, 605
See application file for complete search history.

(56) References Cited

U.S. PATENT DOCUMENTS

| | | | | |
|---|---|---|---|---|
| 3,973,368 | A * | 8/1976 | Moeller | 52/476 |
| 4,438,613 | A * | 3/1984 | Hintsa et al. | 52/506.09 |
| 4,548,010 | A * | 10/1985 | Hintsa | 52/506.09 |
| 4,611,444 | A | 9/1986 | Nassof | |
| 4,760,677 | A | 8/1988 | Nassof | |
| 4,819,549 | A * | 4/1989 | Gillingham et al. | 454/187 |
| 5,417,025 | A * | 5/1995 | Nute et al. | 52/483.1 |
| 5,428,930 | A * | 7/1995 | Bagley et al. | 52/506.07 |
| 5,535,566 | A * | 7/1996 | Wilson et al. | 52/506.07 |
| 5,966,887 | A * | 10/1999 | Mieyal | 52/506.07 |
| 6,230,463 | B1 * | 5/2001 | Bodine | 52/506.07 |
| 6,270,546 | B1 * | 8/2001 | Jeanseau et al. | 55/385.2 |
| 6,971,210 | B2 * | 12/2005 | Kliegle et al. | 52/506.07 |
| 7,076,928 | B2 * | 7/2006 | Kliegle et al. | 52/506.09 |
| 7,647,739 | B2 * | 1/2010 | Boyd | 52/506.05 |
| 2004/0172907 | A1 * | 9/2004 | Krantz-Lilienthal et al. | 52/506.05 |
| 2007/0193131 | A1 | 8/2007 | Ortiz | |
| 2009/0308013 | A1 * | 12/2009 | Miklosz et al. | 52/506.06 |
| 2011/0252736 | A1 * | 10/2011 | Bailey et al. | 52/506.07 |
| 2012/0023853 | A1 * | 2/2012 | Gerkes et al. | 52/506.06 |

OTHER PUBLICATIONS

Perspective View of Exterior Exterior Designer Ceiling System, WMATA Exterior Designer, Intralite, Inc., 1 Sheet.

* cited by examiner

*Primary Examiner* — Mark Wendell
(74) *Attorney, Agent, or Firm* — Christie, Parker & Hale, LLP

(57) ABSTRACT

A suspended metal ceiling system having a grid of support members suspended from a structural ceiling and a plurality of ceiling panels positioned on the grid of the support members having a locking mechanism for connecting the ceiling panels to the grid actuatable from a side wall of the ceiling panels.

15 Claims, 7 Drawing Sheets

METAL CEILING SYSTEM HAVING LOCKING PANELS WITHOUT VISIBLE ACCESS HOLES

CROSS-REFERENCE TO RELATED APPLICATION(S)

This application claims priority to U.S. Provisional Application No. 61/325,159 filed Apr. 16, 2010, the contents of which are incorporated herein by reference.

BACKGROUND OF THE INVENTION

The present invention is directed to a suspended metal ceiling system, and more particularly to a metal ceiling system having locking panels without visible access holes.

Suspended ceiling systems are known in which metal ceiling panels are supported by inverted T-shaped support and frame members which are suspended from the structural ceiling of a room or building. Prior suspended ceiling systems include ceiling panels that are placed on horizontal base portions of the inverted T-shaped support members resulting in the T-shaped members being exposed. For particular applications, it is desired that the T-shaped support members be concealed. In such applications the individual ceiling panels must be attached to the support structure in a manner which conceals the support structure. For such configurations it is desirable that the ceiling panels be secured to the support structure so that they cannot become dislodged for any reason. This is particularly problematic when ceiling systems are used for outdoor applications which are subject to environmental conditions such as the wind. In such applications, it is desirable to provide a locking mechanism for the individual ceiling panels to be secured to the support structure. In locking applications, it is necessary to be able to easily unlock the panels to gain access above the suspended metal ceiling, however for aesthetic reasons holes should not be positioned on a visible surface of the ceiling panel in order to access the locking mechanism. Consequently a need exists for a new suspended metal ceiling system having locking panels without visible access holes.

SUMMARY OF THE INVENTION

The present invention is a suspended metal ceiling system having individual metal panels having a locking mechanism for rigidly securing the ceiling panels to the support structure without having access holes for the locking mechanism on a visible surface. In particular, the present invention provides a suspended ceiling system which comprises a plurality of inverted T-shaped support members suspended from the structure ceiling of the room or application, each T-shaped member having a horizontal base portion. The ceiling system further includes a grid of T-shaped support members including rows of horizontally extending support members and laterally extending support members forming the grid. A plurality of metal ceiling panels are positioned over each opening formed in the horizontally and laterally spaced openings in the grid. Each of the laterally spaced T-shaped support members are also referred to as a main tee member and each of the horizontally positioned T-shaped members are also referred to as a cross tee member.

The metal ceiling panels are attached to the main tee members by having a torsion spring attachment on either side of the panel. The ceiling panels are locked to the main tee members by having a slide clip arrangement positioned on either end of the ceiling panel on both sides of the panel creating four points of locking attachment. Each slide clip is positioned on either end of a panel stiffener located along each side of the ceiling panel. Each slide clip includes a spring for engagement and exterior loading. Each slide clip includes a screw shaft which extends through an opening on a side wall of the panel which can be engaged by a bladed tool to operate the slide clip to lock and unlock the ceiling panel.

These and other aspects of the present invention can be more fully understood with reference to the accompanying drawings.

DETAILED DESCRIPTION

Figure 1:
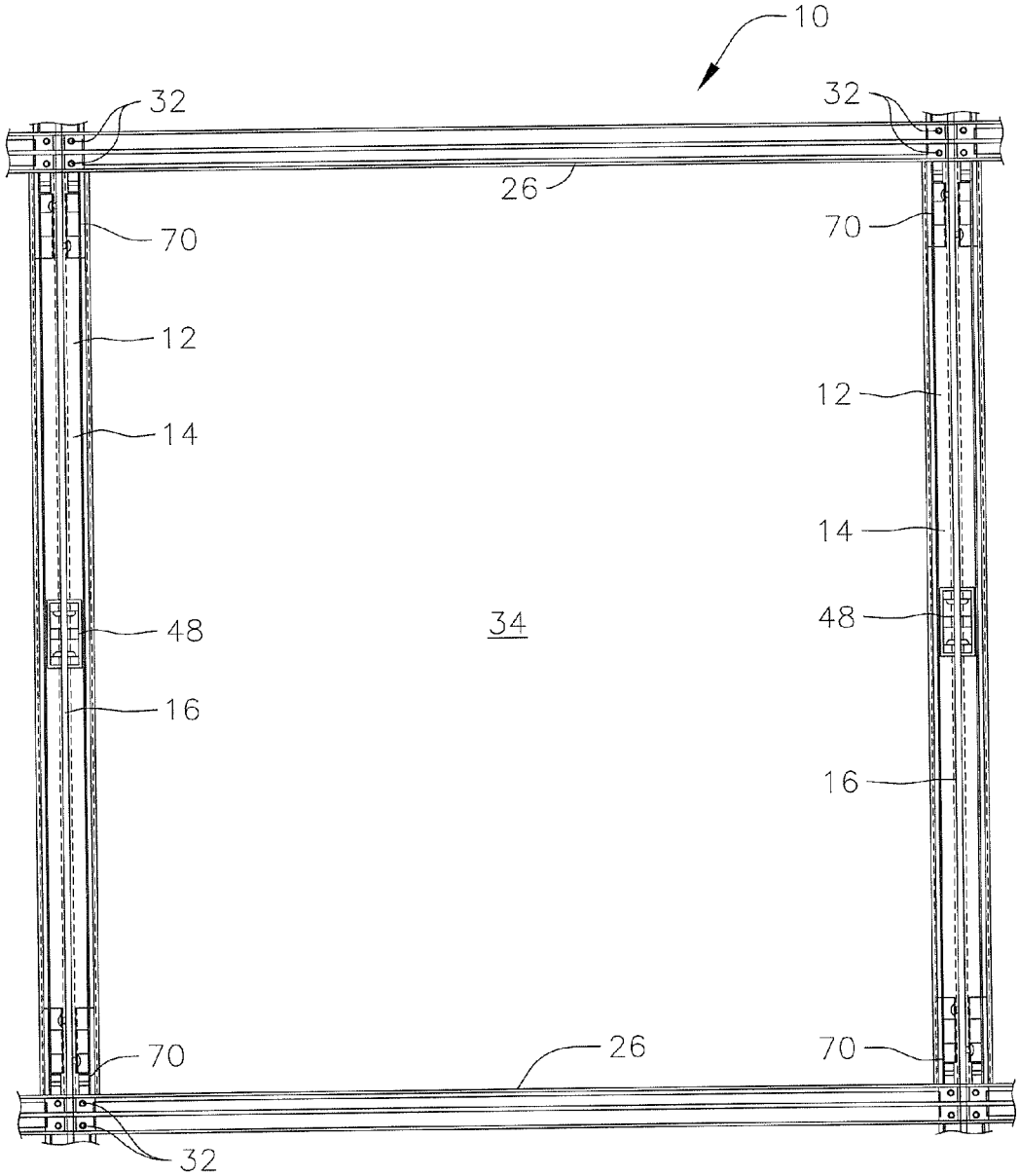
FIG. 1 is a top view of a single ceiling panel as attached to the support structure of the present invention.
Figure 2:
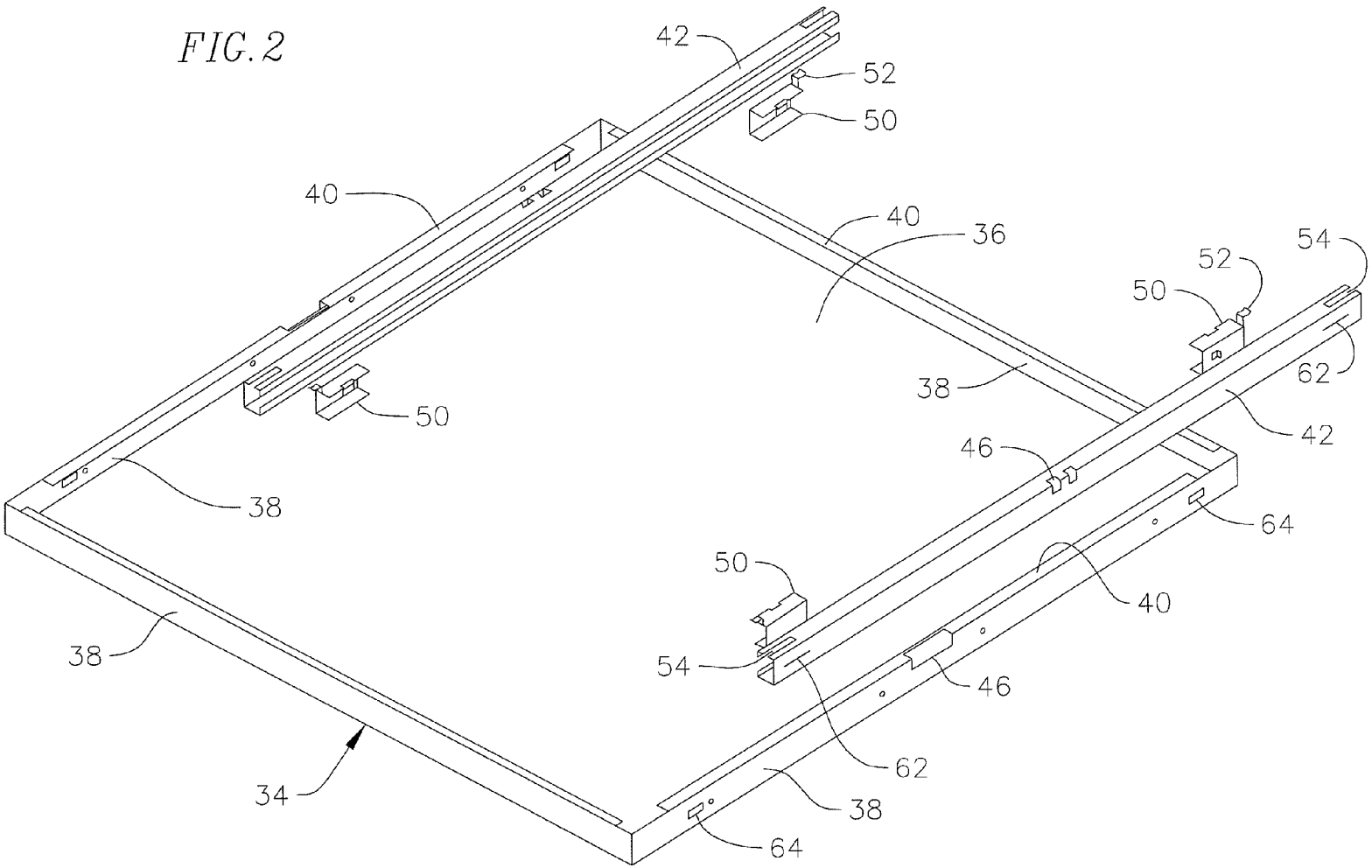
FIG. 2 is an exploded perspective view of the ceiling panel of FIG. 1.
Figure 3:
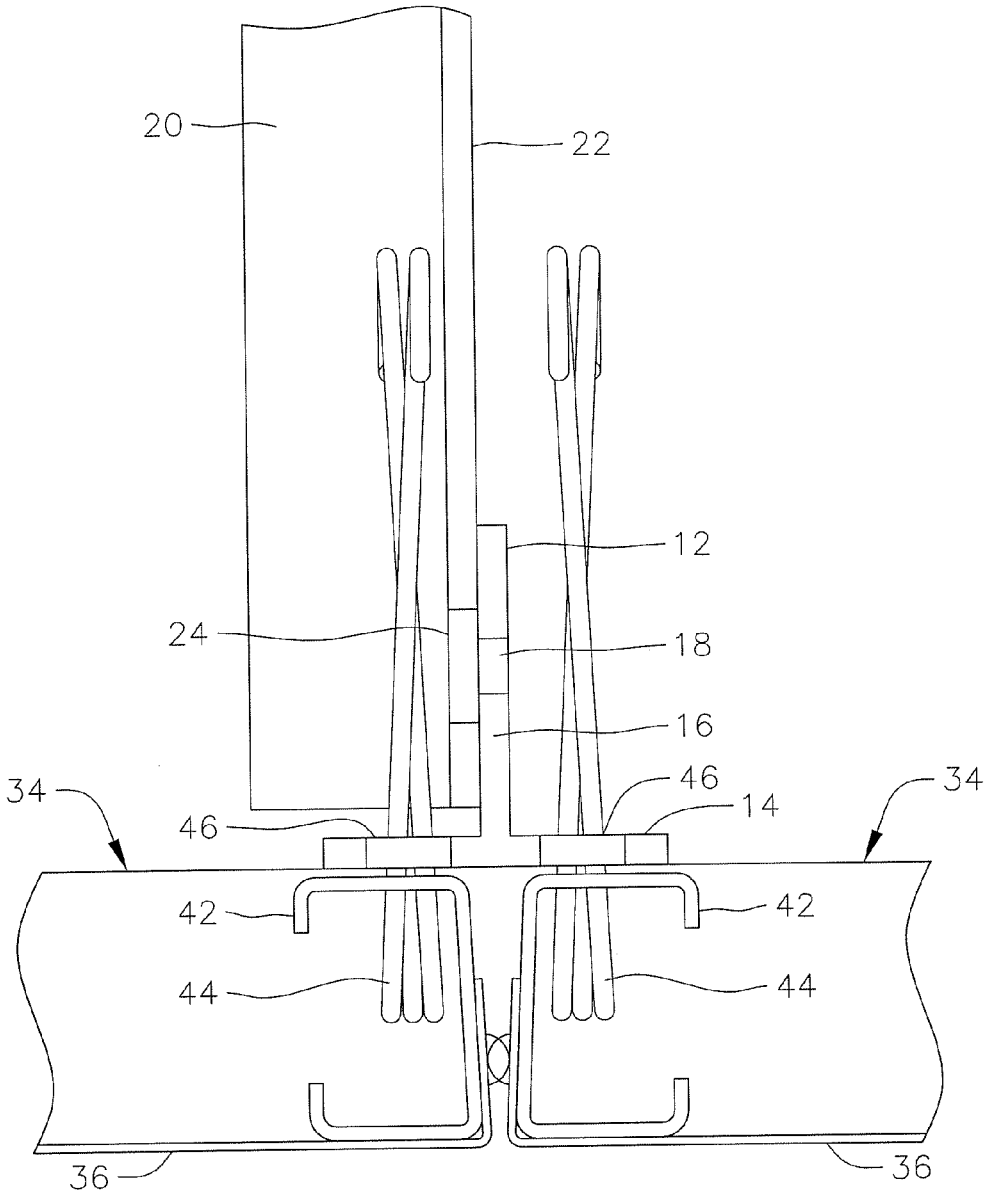
FIG. 3 is a cross-sectional view of two adjacent ceiling panels taken along the main tee member of the support structure of FIG. 1.
Figure 4:
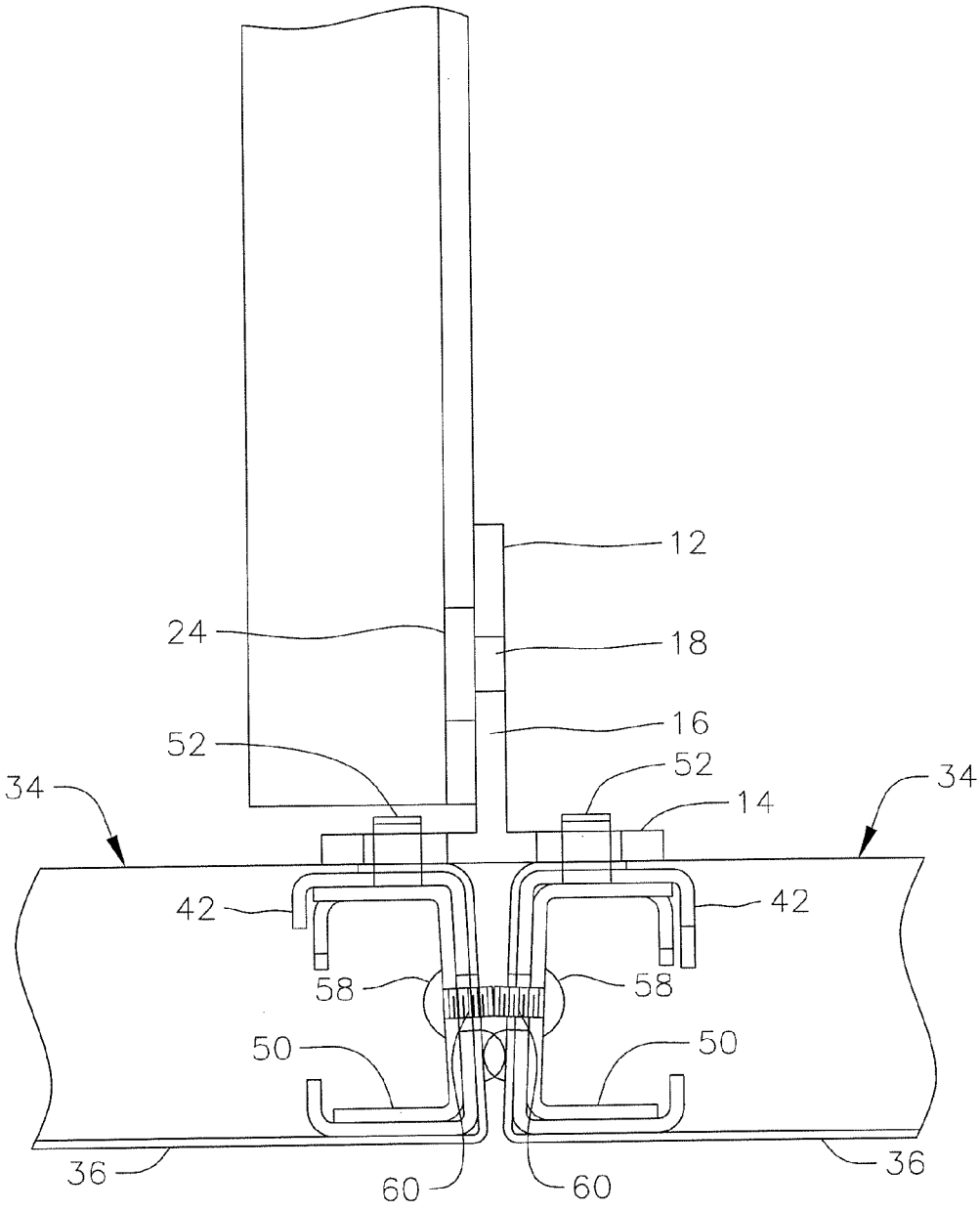
FIG. 4 is a cross-sectional view of two adjacent ceiling panel members taken through the slide clips of FIG. 1.

Referring to FIGS. 1-4, a suspended metal ceiling system 10 of the present invention is illustrated. The suspended metal ceiling system 10 includes a plurality of laterally spaced apart rows of T-shaped support members 12 also referred to as main tee members. As with all the T-shaped support members for the ceiling system, main tee 12 includes a horizontal base portion 14 and a vertical portion 16. Vertical portion 16 includes a plurality of spaced apart holes 18 in which is positioned a fastener to connect the main tee member to a T-shaped hanger 20 which extends from a ceiling or other overhead structure. The vertical portion 16 of main tee member 12 is attached to the hanger 20 on its base portion 22 which also has holes 24 aligned with holes 18. Intersecting, and connected to main tee members 22 are a plurality of spaced apart T-shaped horizontal support members 26 also referred to as cross tee members. Cross tee members 26 also have a horizontal base portion 28 and a vertical portion 30. The rows of main tee members and cross tee members intersect and are connected to form a patterned array and rigid support structure. The horizontal base portions of the main tee members and the cross tee members are rigidly connected to one another at the intersection by rivets or other suitable fasteners 32.

A metal panel 34 is positioned over each opening formed by the main tee members and the cross tee members. As seen best in FIG. 2 the metal panel 34 comprises a horizontal surface 36 and vertical side walls 38 positioned around the perimeter of the horizontal surface 36. The edge of vertical side walls 38 is folded over to provide a top horizontal surface 40. A c-shaped panel stiffener 42 is positioned on opposite inside surfaces of the vertical side walls of the metal ceiling panel adjacent the main tee members 12 and extend along the side of the metal ceiling panels below the horizontal base member of the main tee members.

The metal ceiling panels are attached to the main tee members 12 by a torsion spring 44 which extends through slots 46 in the panel stiffener, the vertical side walls 38 and top horizontal surface 40 in the metal ceiling panel, and in the horizontal base portion 14 of the main tee member. There are separate torsion spring attachment locations, generally referred to as reference number 48 in FIG. 1 on either side of the metal ceiling panel.

Figure 5:
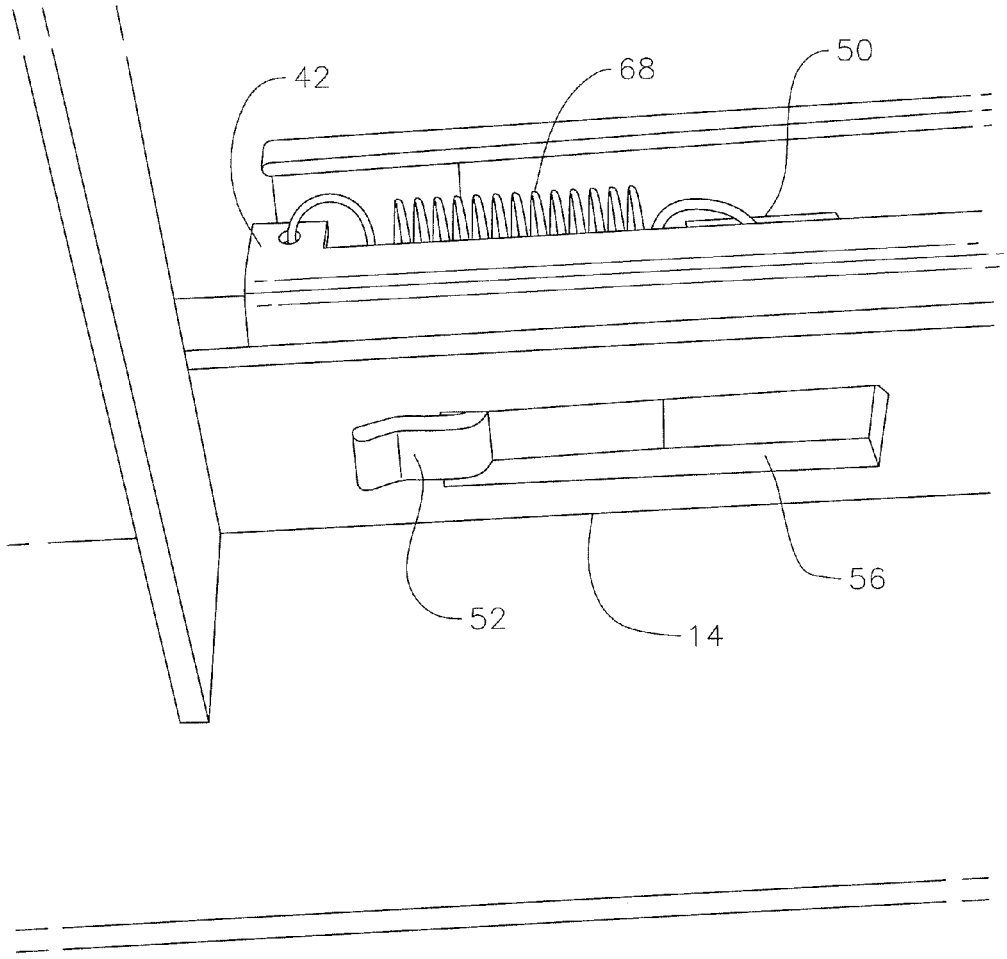
FIG. 5 is a detail view of the slide clips of FIG. 1.
Figure 6:
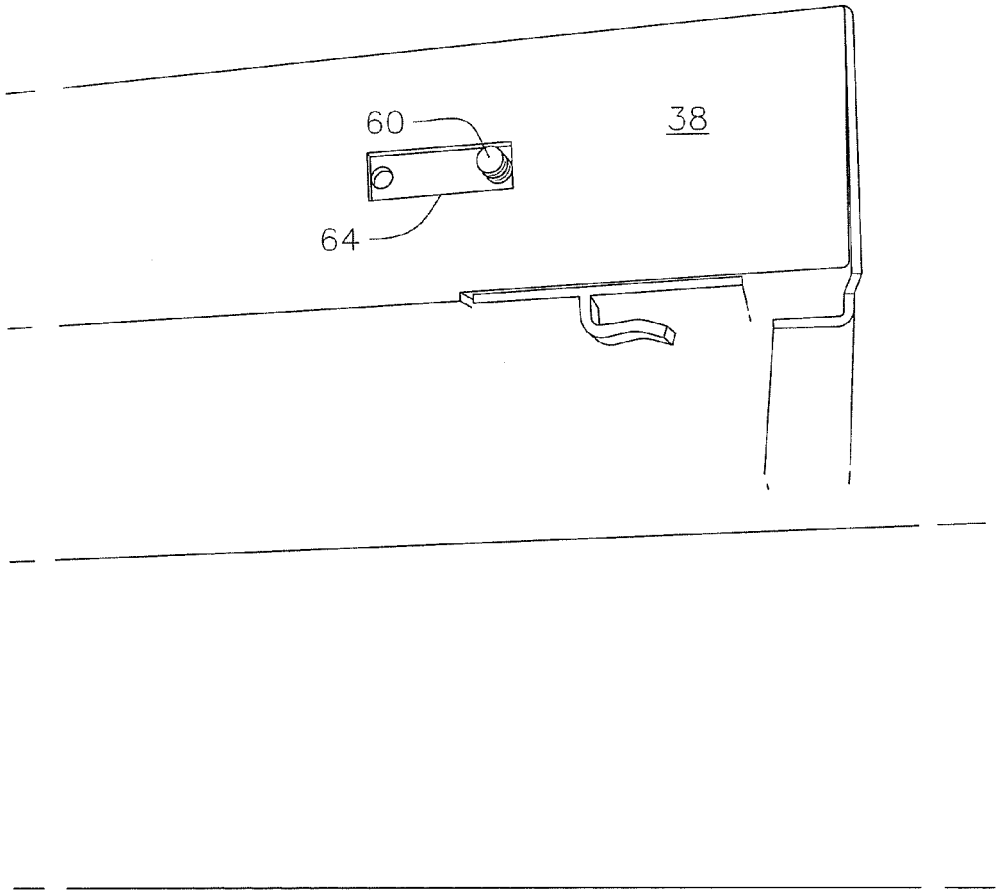
FIG. 6 is a side view of the slide clip in the locked position.
Figure 7:
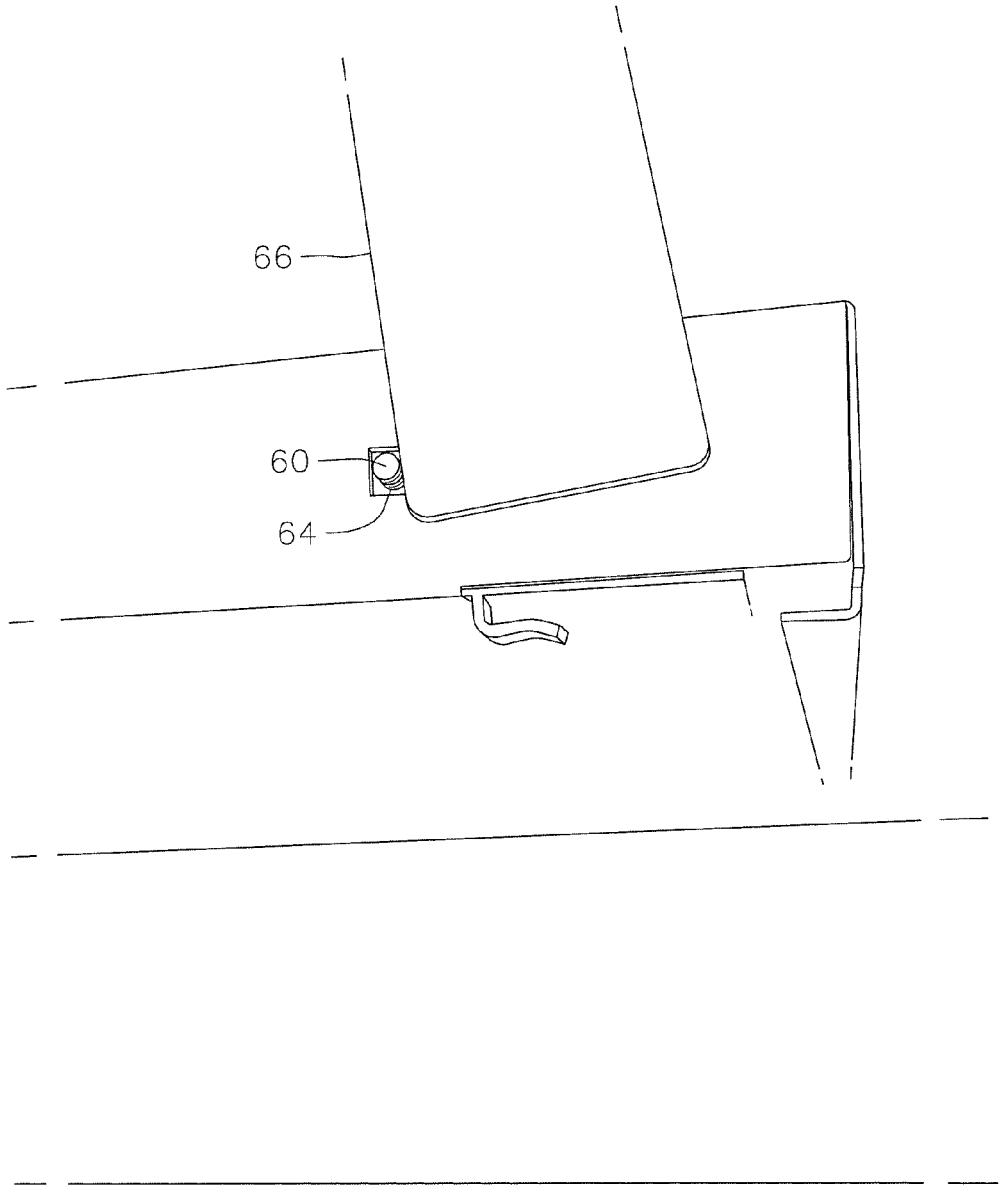
FIG. 7 is a side view of the slide clip in an unlocked position.

The metal ceiling panels are locked into place to the main tee members by a c-shaped slide clip 50 positioned at each end of the panel stiffener 42 on either side of the ceiling panel. The slide clip 50 is positioned within the channel of the panel stiffeners as seen best in FIG. 4 and includes a flange 52 extending from an upper surface of the slide clip. Flange 52 extends through a slot 54 in the end of the panel stiffener and a slot 56 in the horizontal base portion 14 of main tee member 12. The top horizontal surface 40 is cut away at its end to accommodate travel of the flange 52. As seen best in FIG. 5 flange 52 slides within slot 56 to an end of the slot so that it engages the horizontal base portion to lock the metal ceiling panel to the main tee member. The slide clip 50 includes a screw 58 which has a shaft 60 which extends through a slot 62 in the side wall of the panel stiffener and a slot 64 in the vertical side wall 38 of the metal ceiling panel as seen best in FIG. 6. As shown in FIG. 7 to disengage flange 52 from the main tee member to unlock the ceiling panel, a bladed tool 66 is slid between adjacent ceiling panels along vertical side walls 38 to engage the end of the shaft 60 and slide the shaft within the slot 64 to disengage the flange from the base of the main tee member. As shown best in FIG. 5 the slide clip includes a torsion spring 68 which is attached between the slide clip 50 and the end of the panel stiffener 42. The torsion spring 58 biases the slide clip and the flange in the locked position. As the stud moves the slide clip out of disengagement, the spring expands and when the stud is released the spring pulls the slide clip back into a locking engagement.

As shown in FIG. 1 the locking slid clip arrangement, generally shown as reference 70 is positioned in each corner of the metal ceiling panel. As can be appreciated, the metal ceiling panel of the present invention has been designed to provide a locking engagement without visible access holes by incorporating the locking feature with its means for engaging and disengaging on a side surface between individual panels and not visible from a viewing orientation of the ceiling panels.

The components of the present invention are made of metal, for example aluminum, however other materials are contemplated by the present invention. Further by way of example a typical ceiling panel can have a 30×30 inch dimension. However, other sizes are contemplated herein. The ceiling panels further can include acoustical design considerations and can have a plurality of finishes including metal or wood laminates.

Although the present invention has been described and illustrated with respect to a preferred embodiment thereof, it is to be understood that changes and modifications can be made therein which are within the full intended scope of this invention as hereinafter claimed.

What is claimed is:

1. A suspended ceiling system comprising:

a grid of support members suspended from a structural ceiling;

a plurality of ceiling panels positioned on the grid of support members; and at least one slide clip for each ceiling panel for lockably connecting the ceiling panels to the grid, the slide clip is actuatable from a locked position along a side wall of the ceiling panels, wherein the slide clip is biased in the locked position by a compression spring and wherein the slide clip has a stud extending through the side wall of the ceiling panel.

2. The ceiling system of claim 1 wherein the grid of support members includes rows of main tee members intersected by rows of cross tee members.

3. The ceiling system of claim 2 wherein the main tee members and the cross tee members are T-shaped.

4. The ceiling system of claim 1 wherein the ceiling panels are metal.

5. The ceiling system of claim 4 wherein the ceiling panels further include panel stiffeners positioned along opposite sides of the panel.

6. The ceiling system of claim 5 wherein a slide clip for lockably connecting the ceiling panels is positioned at each opposite end of the panel stiffeners.

7. The ceiling system of claim 6 wherein the slide clip has a flange which engages the support members.

8. The ceiling system of claim 1 wherein the compression spring is positioned between and connected to the slide clip and the panel stiffener.

9. A locking panel suspended ceiling system comprising:

a plurality of horizontal support members;

a plurality of lateral support members intersecting the horizontal support members;

a plurality of ceiling panels positioned over the horizontal support members and the lateral support members; and at least one locking mechanism positioned on each ceiling panel having a spring to bias the locking mechanism into locking engagement with at least one of the horizontal support members or lateral support members, wherein the locking mechanism has means for disengaging the support member extending through a side wall of the ceiling panel.

10. The ceiling system of claim 9 wherein the horizontal support members and the lateral support members are T-shaped.

11. The ceiling system of claim 9 wherein the ceiling panels are metal.

12. The ceiling system of claim 11 wherein the ceiling panels further include panel stiffeners positioned along opposite sides of the ceiling panels.

13. The ceiling system of claim 12 wherein the locking mechanism is a slide clip positioned at each opposite end of the panel stiffeners.

14. The ceiling system of claim 13 wherein the slide clip has a flange which engages the support member.

15. The ceiling system of claim 14 wherein the slide clip has a stud extending through the side wall of the ceiling panel.

* * * * *